United States Patent [19]

Keddie et al.

[11] 4,078,924

[45] Mar. 14, 1978

[54] IMAGING SURFACE SMOOTHING WITH ROUGHENED NICKEL FOIL

[75] Inventors: Eric Norman Keddie, Welwyn Garden City; Charles Graham Cook, Welwyn, both of England

[73] Assignee: Xerox Corporation, Stamford, Conn.

[21] Appl. No.: 701,763

[22] Filed: Sep. 13, 1976

[51] Int. Cl.[2] ..... G03G 5/04

[52] U.S. Cl. ..... 96/1 LY; 96/1 R; 96/1.5 R; 15/256.52; 51/281 R; 51/289 R; 101/425; 118/652; 355/10; 355/15; 427/16; 427/359

[58] Field of Search ..... 51/281 R, 289 R, 328; 427/15, 76, 16, 359; 96/1 LY, 1.5; 134/6; 15/256.52; 355/10, 15; 118/652; 101/425

[56] References Cited

U.S. PATENT DOCUMENTS

| | | | |
|---|---|---|---|
| Re. 29,323 | 7/1977 | Kawakubo et al. | 355/15 X |
| 3,079,741 | 3/1963 | Render | 51/289 R |
| 3,579,927 | 5/1971 | Coes | 51/281 R |
| 3,610,693 | 10/1971 | Solarek | 355/15 X |
| 3,649,992 | 3/1972 | Thettu | 15/256.52 |
| 3,815,295 | 6/1974 | Lanker | 51/289 R |
| 3,835,597 | 9/1974 | Wasil | 51/289 R |
| 3,849,171 | 11/1974 | Takahashi et al. | 96/1 LY |
| 3,850,631 | 11/1974 | Tamai | 96/1.8 X |
| 3,860,421 | 1/1975 | Tecek | 427/76 |
| 3,914,045 | 10/1975 | Namiki et al. | 355/15 |
| 3,943,666 | 3/1976 | Dion et al. | 51/281 R |
| 3,950,092 | 4/1976 | Zoltner | 355/15 |
| 4,007,983 | 2/1977 | Kneiser | 355/15 |

*Primary Examiner*—Edward C. Kimlin
*Attorney, Agent, or Firm*—J. J. Ralabate; James Paul O'Sullivan; Donald M. MacKay

[57] ABSTRACT

A method and device for improving xerographic development of non-metallic photoreceptor imaging surfaces containing irregularities of 5 microns or larger by contacting and moving a smoothing and abrading means against the irregular surface in the presence of an interposed hydrodynamic hydrostatic fluid bearing.

21 Claims, 6 Drawing Figures

IMAGING SURFACE SMOOTHING WITH ROUGHENED NICKEL FOIL

BACKGROUND OF THE INVENTION

The invention relates to electrostatography, and more particularly to improvements in electrostatographic imaging surfaces.

In the art of electrostatographic copying, as originally disclosed by Carlson in U.S. Pat. No. 2,297,691, and as further described in many related patents in the field, an electrostatographic imaging surface containing a photoconductive insulating layer is first given uniform electrostatic charge in order to sensitize its entire surface. The surface is then exposed to an image of activating electromagnetic radiation such as light, X-ray, or the like, which selectively dissipates the charge in the illuminated areas of the photoconductive insulator while leaving a charge pattern in the non-illuminated areas. The charge pattern is then developed and made visible by depositing finely divided marking material (referred to in the art as "toner") on the surface of the photoconductive insulating layer. Where reusable photoconductive insulating material is used, the visible image formed by the toner is transferred to a second surface, such as a sheet of paper, and fixed in place thereon to form a permanent visible reproduction of the original image. Where a nonreusable photoconductive insulating material is used, the toner particles are directly fixed in place on the surface of the nonreusable insulating material thereby eliminating the transfer step from the previous process.

Such a charge pattern may also be developed by a liquid developer. In one known liquid development process a charge pattern is established on an imaging surface and is developed by a liquid development process wherein the liquid developer is presented to the charge pattern by an applicator which has a surface comprising raised portions (lands) and recesses (valleys) adapted to contain liquid developer between the raised portions. The liquid developer is drawn to the imaging surface in image configuration by the electrostatic forces of the charge pattern.

A preferred method for the liquid development of electrostatic charge patterns is shown in British Patent 880,597. In this method the imaging surface may be a cylindrical member which is cyclically imaged with a charge pattern which is developed and the developed image transferred to a record receiving means after which the imaging surface is cleaned in preparation for subsequent such cycles.

Imaging surfaces which are suitable for use with either the toner development or liquid development of charge patterns are desirably photoconducting insulating layers which are sufficiently rigid to support a developed image. If used in a cyclic mode, as described above, it can also be desirable to use imaging surfaces which are somewhat flexible and which may be easily cleaned. In any event the surface of the layer should be sufficiently smooth that the quality of the developed image is not marred. Examples of such imaging surfaces are described in U.S. Pat. Nos. 3,552,848; 3,621,248; 3,685,989; 3,697,265 and 3,752,691.

While ordinarily capable of producing good quality images, the imaging surface of the prior art can be improved in certain areas. Imaging surfaces have been found to have surface defects in the form of "hills" or "bumps" which may protrude as much as 100 microns above the imaging surface. Such defects are thought to be formed during the plating process used to coat the photoconductive material onto a substrate. They are often found on imaging surfaces which are commonly used in both toner and liquid development of charge patterns.

Such surface defects do not ordinarily adversely affect the quality of toner developed images, however, they are found to detract to a much greater degree from the quality of liquid developed charge patterns. In the case of the liquid development of charge patterns on such an imaging surface, the surface defects cause at least two undersirable imperfections in the developed image. The liquid developer gathers in a circle around the defect so that it transfers as a circle onto the image receiving surface. This is commonly known in the art as the "halo effect". A second undesirable imperfection occurs after a plurality of copies have been made by known liquid development methods as described, for instant, in British Pat. No. 880,597. When a liquid developer applicator is rotated in contact with an imaging surface, the applicator will tend to strike against the imperfections on the imaging surface. The larger imperfections and those having a steep profile are sometimes broken off. The resulting roughened area or hollow tends to collect liquid developer which appears as an unwanted spot in the developed image whether the developed image remains on the imaging surface or is transferred to an image receiving means.

It has been proposed in a copending U.S. patent application, Ser. No. 701,764, to reduce such troublesome surface defects by contacting the imaging surface with a smoothing means which "cold-flows" the defects to substantially reduce their height to less than about 5 microns. Such a method has been found particularly satisfactory when used with metal or metal-like imaging surface materials. Upon occasion, however, the surface defects have a sharp profile which can be inadvertently broken off by such smoothing means to form the undesirable roughened areas or hollows described above. In addition, smoothing or cold flow techniques are not always completely successful when used with non-metallic photoreceptor materials which are less compatible with a cold flowing process.

It is, therefore, an object of the invention to provide a method for improving liquid developing characteristics of a non-metallic xerographic imaging surface having surface irregularities in excess of about 5 microns.

The above object is obtainable in accordance with the present invention through initially treating the imaging surface by contacting with smoothing and abrading means having a patterned surface at the points or lines of contact, and slidably moving the smoothing and abrading means alone or in combination with and relative to the xerographic imaging surface in the presence of an interposed fluid bearing.

Such interposed fluid bearing can usefully be of a hydrodynamic or hydrostatic nature depending upon the nature and shape of the photoreceptor.

The invention will now be described in greater detail and with reference to the drawings in which.

Figure 1:
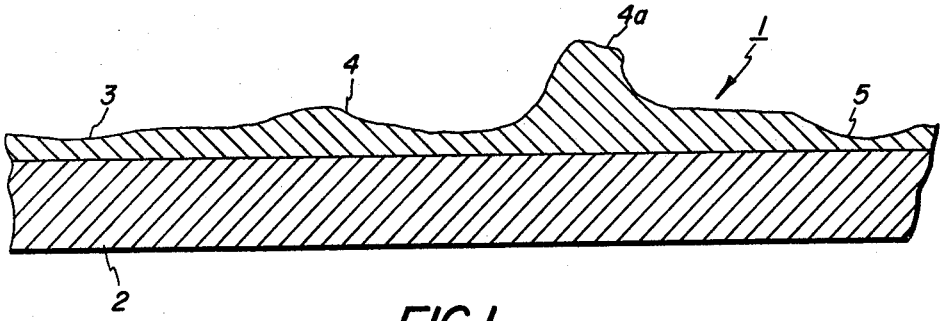
FIG. 1 shows schematically and in cross-section a greatly enlarged portion of an imaging surface having surface defects thereon.

Referring more specifically to FIG. 1, there is shown a blown up section of an imaging surface generally depicted as (1) which comprises a conductive substrate (2) having coated thereon a photoconductive insulating layer (3). Surface defects (4) and (4*a*) are shown on the upper surface of the layer (3) and represent typical surface defects obtained in coating a xerographic photoconductive layer on a substrate. Also demonstrated in FIG. 1 is a hollow (5) which is a further surface defect generally occurring when a surface projection such as defect (4*a*) is mechanically torn away by the routine application of a xerographic liquid developer with an applicator.

When desired, the photoreceptor described above can include known modifications such as a thin interface layer (not shown) between layer (3) and substrate (2) for the purpose of enhancing electrical xerographic properties of the imaging surface and also to improve adhesion of layer (3) to substrate (2).

For purposes of the present invention, the substrate (2) can be formed from conventional electrically conductive material such as brass, aluminum, steel, nickel or the like. It can be flexible or rigid and utilized in the form of a belt, a cylinder or a plate as desired.

Photoconductive layer (3) is conveniently formed from any suitable photoconductive insulating material. The coating can, for instance, comprise a photoconductor dispersed in an insulating binder composition, a solution of photoconductor and or may consist of a homogeneous photoconductive composition. When used in the dispersed phase, however, a photoconductive layer generally consists of an organic or inorganic photoconductive material dispersed in an insulating binder composition.

While any suitable photoconductive materials can be used for purposes of the invention, inclusive of inorganic and organic materials, non-metallic photoconductive materials are particularly preferred. Examples of such materials include, for instance, triphenylamine; 2,4-bis(4,4'-diethylaminophenyl)-1,3,4-oxadiozole; N-isopropylcarbazole; triphenylphyrrol; 4,5-diphenylimidazolidinone; 4,5-diphenylimidazolidinethione; 4,5-bis(4'-amino-phenyl)-imidazolidinone; 1,5-dicyanonaphthalene; 1,4-dicyanonaphthalene; aminophthalodinitrile; nitrophthalodinitrile; 1,2,5,6-tetraazacyclooctatetraene-(2,4,6,8); 2-mercaptobenzthiazole-2-phenyl-4-diphenylideneoxazolone; 6-hydroxy-2,3-dic-methoxy-phenyl)-benzofurane; 4-dimethylamino-benzylidene-benzhydrazide; 3-benzylideneaminocarbazole; polyvinylcarbazole; (2-nitrobenzylidene)p-bromoaniline; 2,4-diphenylquinazoline; 1,2,4-triazine, 1,5-diphenyl-3-methylpyrazoline; 2-(4'-dimethylaminophenyl)-benzoxazole; 3-aminocarbazole; phthalocyanines and mixtures thereof.

Where binder material is incorporated within the photoconductive insulating layer, such can include materials such as or similar to those disclosed in U.S. Pat. Nos. 3,121,006 and 3,121,007.

The specific binder material chosen usually depends upon the nature of the photoconductive pigment utilized to prepare the photoconductive layer. The binder material employed with the photoconductive compound is usefully an insulator at least to the extent that an electrostatic charge can be substantially maintained on the photoconductive layer, in the absence of illumination. The binder material must also adhere tightly to the base of the conductive substrate (2) and provide an efficient dispersing medium for the photoconductive pigment. Further, suitable binder material is selected which is relatively inert in the presence of the photoconductive compound.

Typical nonphotoconductive organic binders include, for instance, polystyrene, epoxy resins such as the Epon resins (commercially available from the Shell Chemical Company); epoxyphenolic compounds; epoxy-novolaks, silicone resins such as DC801, DC804 and DC996 (commerically available from the Dow Corning Corporation); polysulfone; acrylic and methacrylic polyesters (such as Acryloid A10 and Acryloid B75) and polymerized ester derivatives of acrylic and alpha acrylic acids (all commerically available from Rohm and Haas Company); Lucite, a polymerized butyl methacrylate (commercially available from E. I. DuPont de Nemours and Company); and vinyl polymers and copolymers such as polyvinylchloride and polyvinylacetate and mixtures thereof.

When the binder material itself is photoconductive, however, then a homogeneous layer of the binder can be used as layer (3). In such situation, it is preferred that the specific resistivity of the binder be at least $10^{13}$ ohms cm to satisfactorily fulfill the requirements of the resulting photoconductive insulating plate. Typical photoconductive binders within the above parameters are selenium, sulfur, polyvinylcarbazole, anthracene, and resinous charge transfer complexes of the type found, for instance, in U.S. Pat. No. 3,408,183; 3,408,186, 3,408,184; 3,408,182 and 3,408,185, whether used alone or as mixtures.

In addition to the use of the photoconductive materials and binders disclosed above, the photoconductive layer can also be prepared from a glass binder. Such binders are listed, for instance, in U.S. Pat. No. 3,151,982.

Although the method of the invention is useful in connection with imaging surfaces comprising photoconductive layers made from any of the above described materials, said method is observed to work most efficiently on the more brittle non-metallic photoconductive materials.

In the typical imaging surface exemplified by FIG. 1, layer (3) is normally although not necessarily up to about 60 microns in depth and such defects such as (4), (4*a*) and (5) of sufficient corresponding size to cause an undesirable halo effect when liquid developed. It is generally, in this connection, that when defects (4) and (4*a*) are greater than about 5 microns in height, they are not only capable of causing print defects such as "halo effects" but also of breaking away to form depressions such as (5) with spots on the resulting print.

Figure 2:
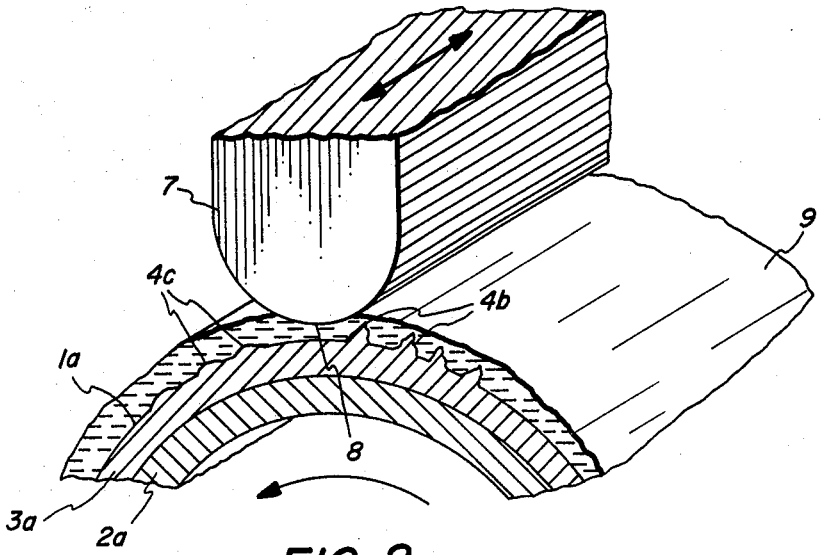
FIG. 2 shows schematically in broken cross-section a blown up arrangement for carrying out a method of the present invention using a hydrodynamic fluid bearing.

Referring now to FIG. 2, there is shown a portion of a cylindrical imaging surface (1*a*) inclusive of a substrate (2*a*) and a layer (3*a*) such as described in FIG. 1 with irregularities shown both before (4*b*) and after (4*c*) smoothing. It is understood, however, that the imaging surface, for purposes of the present invention, can be either flat or curved, and that the cylindrical shape is chosen as a exemplary embodiment.

For purposes of the present invention, the reduction of surface defects on the cylindrical surface described is achieved by smoothing and abrading means (7) which is pressed or pressed and reciprocated against the cylindrical imaging surface while being held apart therefrom by a hydrodynamic fluid bearing (8). The hydrodynamic fluid, preferably formed as a film, is between abrading means (7) and the cylindrical imaging surface.

To be useful in the invention, the smoothing and abrading means (7) can be hard enough to abrade the high irregularities of the photoreceptor materials without itself being damaged. It should have a sufficiently roughened surface to abrade typically encountered surface defects and to reduce them to sizes of less than about 5 microns without tearing them out and also without completely penetrating the fluid bearing so as to mar the smoother parts of the photoconductor surface. Preferably such abrading material is also somewhat flexible so that it can conform to the general contour of the imaging surface.

Any suitable abrasive material may be used for purposes of the present invention. Typically useful are materials such as steel, nickel and chromium foils. Especially good results, however, have been achieved with nickel foil having a surface roughness of from about 6 to about 20 microns/inch center line average (CLA). Such foils can be used in a total thickness of 0.032 inch and is typically 8 layers of 0.004 inch foil. Three outer layers of foil and a 0.015 inch thickness of backing material have also been found to be useful.

Abrasive means having a surface roughness of more than about 20 microns/inch CLA are found to sometimes break through the fluid bearing to tear the smooth photoconductor surface while a surface roughness of less than about 6 microns/inch (CLA) gives reduced smoothing efficiency.

Smoothing and abrasive means (7) can be applied against the imaging surface sought to be smoothed at any suitable pressure. Typically the pressure range is from about 0.4 to about 8.5 lbs/in$^2$. Generally, however, a reduced smoothing efficiency is observed at a pressure below about 0.4 lb/in$^2$ and undesirable abrasion of the smooth photoreceptor surface can sometimes occur at pressures of greater than about 8.5 lb/in$^2$.

Fluid (9) suitable for obtaining a hydrodynamic fluid bearing effect can be any one of a number of suitable fluids having a viscosity of about 100 cps to 300 cps at 25° C. At viscosities of greater than about 300 cps at 25° C., however, the hydrodynamic fluid begins to separate from the smoothing and abrasive means and the imaging surface to such an extent that satisfactory smoothing no longer occurs. Fluids with a viscosity as low as that of water (1 cps at 25° C.) can be used, however, provided a sufficiently high rate of movement is maintained across the imaging surface. Within this context, very good results are achieved by using an oil such as mineral oil having a viscosity at 25° C. of about 200 cps. Such a viscosity allows the desired hydrodynamic fluid bearing situation to be achieved between the imaging surface and the abrading means while using easily manageable speeds of movement of the imaging surface.

The imaging surface to be smoothed such as the cylindrical imaging surface (6) can be moved at any suitable speed pass the abrading means in order to maintain a suitable hydrodynamic fluid bearing and to cause smoothing of the imaging surface. Typically, the imaging surface is moved past the abrading means to a speed of up to about 2200 inches per minute. A speed of about 850 inches per minute is preferred, however, because such a speed is compatible with the preferred bearing fluid.

Although it is not required, smoothing and abrading means (7) can be vibrated or moved reciprocally during the smoothing operation to enhance the reduction of surface defects on the photoreceptor. Vibrations are generally, although not exclusively, accomplished by oscillating the smoothing and abrading members at right angles to the direction of movement of the imaging surface at frequencies of up to about 10,000 Hz.

Figure 3:
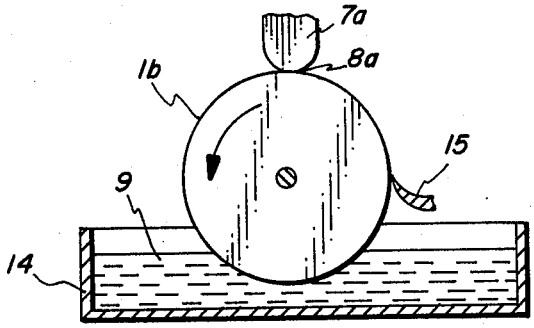
FIGS. 3–5 show schematically and in cross-section, alternative means for applying and metering a fluid onto an imaging surface to form a hydrodynamic bearing.

Referring now to FIG. 3, there is demonstrated a method for preloading a suitable bearing fluid (9) onto an imaging surface such as cylindrical imaging surfaces (1*b*). In this figure, the cylindrical imaging surface is axially rotated in the direction shown by the arrow to immerse parts in bath (14) and thereby pick up a coating of bearing fluid (9). Such a coating can be evenly distributed on the cylindrical imaging surface (1*b*) in an even thickness with a squeeze or similar metering means (15). After metering, the uniform layer of bearing fluid forms a hydrodynamic fluid bearing (8*a*) situated between said imaging surface and the smoothing and abrading means (7*a*).

Any suitable means may be used to meter the thickness of the bearing fluid on the imaging surface. Typically, however, the metering means (15) is a blade such as a wiper blade, a scraper blade of even an absorbent roller.

Figure 4:
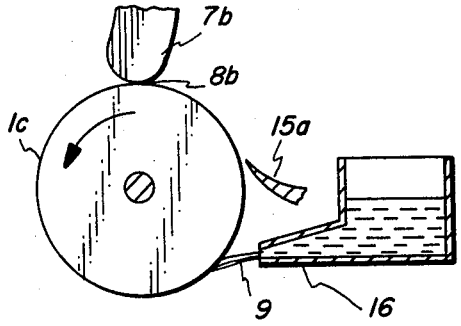

Referring now to FIG. 4, it is noted that an alternative means is provided for applying the bearing fluid (8*b*) to a cylindrical imaging surface (1*c*). Here, the fluid (9) is applied to said surface by nozzle (16) and is then spread and metered onto said surface with a wiping blade such as metering means (15*a*). The nozzle (16) can conveniently be any suitable means for applying a stream of fluid to the imaging surface. Typically, however, it is a nozzle adapted to applying the bearing fluid under pressure or a spout for merely pouring the bearing fluid onto the imaging surface.

Figure 5:
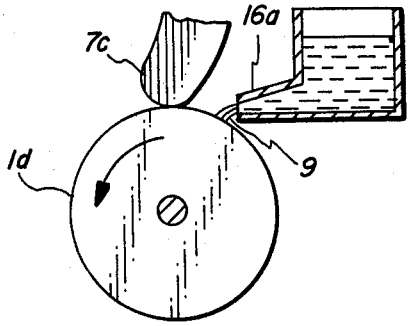
Figure 6:
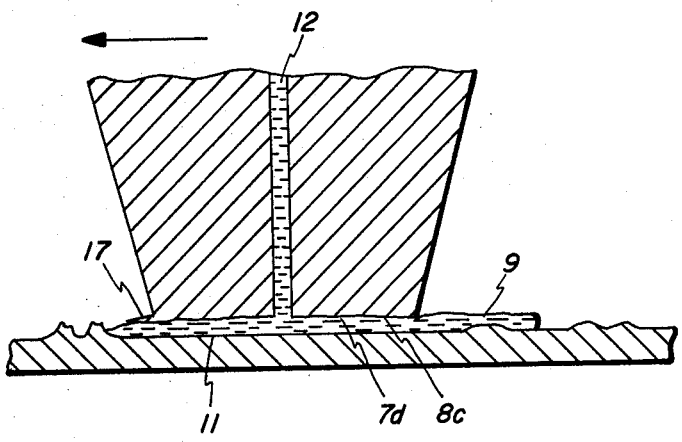
FIG. 6 shows schematically and in cross-section a suitable arrangement for carrying out the method of the present invention by using a hdyrostatic fluid bearing.

Referring now to FIG. 5, there is shown still another means for creating a hydrodynamic fluid bearing between the smoothing and abrading means (7*c*) and the imaging surface (1*d*), whereby the fluid (9) is applied directly to the bearing area by nozzle (16*a*). Under such conditions, the fluid is not metered into the bearing area by a separate means and, thus, the flow of fluid is preferably carefully maintained at a constant rate. In FIG. 6, there is also shown an apparatus for carrying out the method of the present invention when employing a hydrostatic fluid (9*b*) between smoothing and abrading means (7*d*) and a flat imaging surface (11).

Here, the hydrostatic fluid bearing (8*c*) as demonstrated above, is achieved, for instance, by forcing the fluid under pressure through a passage (12) in the smoothing and abrading means (7*d*) so that the smoothing and abrading means is isolated from the flat imaging surface (11). Typical bearing fluids can consist of gasses as well as water and oils having a viscosity up to about 1000 cps at 25° C. The embodiment shown in FIG. 6, however, lends itself readily to use with gasses; here there is no minimum viscosity requirement for the bearing fluid so long as it can pass through passage (12) with sufficient force to hold abrading means (7*d*) away from the flat imaging surface (11). The abrading funcitional surface (13) of abrading means (7*d*) preferably has the same abrasive characteristics as those described in connection with abrasive means (7) of FIG. 2. When desired, however, the abrading means (7*d*) of FIG. 6 can also be oscillated in the manner of smoothing and abrasive means (7) of FIG. 2. Although it is not a preferred embodiment, abrading means (7*d*) may optionally include a cutting edge (17) to deliberately shear off imaging surface defects (not shown) while moving relative to the imaging surface. Also optionally, the smoothing and abrading means can also be used with only a cutting edge and without a roughened functional surface (13). The use of a cutting edge such as cutting edge (17) is not a preferred embodiment because of the danger of tearing the surface defect away from the imaging surface and thereby creating an undesirable hole.

The flat imaging surface (11) need not be moved in order to achieve hydrostatic fluid bearing (8*c*), however, surface (11) can be moved relative to abrasive means (7*a*) when desired, in the manner that surface (1*a*) of FIG. 2 is moved relative to abrasive means (7).

The method described herein and with reference to FIGS. 2–6 is useful to at least substantially reduce surface defects on imaging surfaces such as those shown in FIG. 1 to a size of less than about 5 microns on both inorganic and organic imaging surfaces while at least substantially avoiding further tearing or marring of the imaging surface.

While particular embodiments of the invention are described above, it will be appreciated that various modifications may be made by one skilled in the art without departing from the scope of the invention as described in the appended claims.

What is claimed is:

1. A method for improving liquid developing characteristics of a non-metallic xerographic imaging surface having surface irregularities in excess of about 5 microns to 100 microns, comprising treating the imaging surface by contacting with smoothing and abrading means, comprising a nickel foil having a surface roughness of from about 6 to about 20 microns/inch CLA; slidably moving the smoothing and abrading means alone or in combination with and relative to the xerographic imaging surface in the presence of an interposed fluid bearing to reduce said irregularities to less than 5 microns.

2. The method of claim 1 wherein the fluid bearing is hydrodynamic or hydrostatic in nature.

3. The method of claim 1 wherein said imaging surface comprises an organic photoconductive material coated onto a conductive substrate.

4. The method of claim 3 wherein said imaging surface is a drum.

5. The method of claim 3 wherein said imaging surface is a flexible belt or sleeve.

6. The method of claim 2 wherein the smoothing and abrading means is loaded against said imaging surface at a pressure of from about 0.4 to about 8.5 lbs/in$^2$.

7. The method of claim 2 wherein the relative motion between said imaging surface and said abrading means is produced by moving said imaging surface.

8. The method of claim 7 wherein said imaging surface is moved relative to said abrading means at speeds of up to about 2200 inches/minute.

9. The method of claim 1 wherein the relative sliding motion between said imaging surface and said smoothing and abrading means is obtained by oscillating the abrading means in a plane at right angles to the direction of movement of the surface.

10. The method of claim 9 wherein said abrading means is oscillated at a frequency of up to about 10,000 Hz.

11. The method of claim 1 wherein said fluid bearing is a hydrostatic bearing.

12. The method of claim 11 wherein said hydrostatic bearing is operated using a gas.

13. The method of claim 2 wherein said fluid bearing is a hydrodynamic bearing.

14. The method of claim 13 wherein said hydrodynamic bearing is operated using a liquid having a viscosity of not more than about 1000 cps. at 25° C.

15. The method of claim 14 wherein said liquid is an oil.

16. The method of claim 14 wherein said liquid is applied to said imaging surface and subsequently metered to a substantially even thickness thereon prior to contact with said abrasive means.

17. The method of claim 16 wherein said liquid is metered by a wiping blade.

18. The method of claim 16 wherein said liquid is applied to said imaging surface by means of a bath.

19. The method of claim 16 wherein said liquid is applied to said imaging surface by means of a nozzle.

20. The method of claim 14 wherein said liquid is applied directly between said imaging surface and said abrasive means.

21. The method of claim 20 wherein said liquid is applied by means of a nozzle.

* * * * *